US007556007B2

(12) United States Patent
Nicholas et al.

(10) Patent No.: US 7,556,007 B2
(45) Date of Patent: Jul. 7, 2009

(54) METHOD AND APPARATUS FOR FORMING A SEPTUM FOR AN ENGINE INTAKE MANIFOLD

(75) Inventors: Frank A. Nicholas, W. Henrietta, NY (US); Michael R. Brosseau, Rochester, NY (US); David A. Chinnici, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 254 days.

(21) Appl. No.: 11/636,921

(22) Filed: Dec. 11, 2006

(65) Prior Publication Data

US 2008/0135011 A1 Jun. 12, 2008

(51) Int. Cl.
*F02M 35/10* (2006.01)

(52) U.S. Cl. ..... 123/184.21; 123/184.61; 264/241

(58) Field of Classification Search ..... 123/184.21, 123/184.38, 184.42, 184.61; 264/241, 248
See application file for complete search history.

(56) References Cited

U.S. PATENT DOCUMENTS 6,679,215 B2 1/2004 Benson et al.
7,082,915 B2 * 8/2006 Tanikawa et al. ..... 123/184.42

* cited by examiner

*Primary Examiner*—Noah Kamen
(74) *Attorney, Agent, or Firm*—Paul L. Marshall

(57) ABSTRACT

In a method for forming an injection molded manifold, the portion of the mold that forms a septum is modified to provide a substantially thicker septum, preferably about 8.5 mm or greater. In the molding operation, one or more removable slides are inserted through this region of the mold, each slide being preferably about 2.5 mm thick and about 30 mm wide. The septum is cast around the slides which are then withdrawn from the septum after the polymer composite is set, resulting in a septum that is substantially thicker than a prior art septum, comprising first and second plates, each about 3 mm thick, and a plurality of open core voids about 2.5 mm high and about 30 mm wide between the plates. The improved septum is stiffer than a single 4 mm thick prior art septum, has a higher natural frequency, and improves suppression of engine noise.

7 Claims, 4 Drawing Sheets

METHOD AND APPARATUS FOR FORMING A SEPTUM FOR AN ENGINE INTAKE MANIFOLD

TECHNICAL FIELD

The present invention relates to manifolds for internal combustion engines; more particularly, to manifolds formed by injection molding of polymer composites; and most particularly, to method and apparatus for forming a molded manifold section by coring out a thickened septum thereof to provide a stronger, less-resonant thicker remaining septum.

BACKGROUND OF THE INVENTION

Distribution manifolds for internal combustion engines are well known, especially intake manifolds for distribution of air to the combustion cylinders of an engine. In the older prior art, such manifolds were formed of metal, typically by die casting or "lost mold" casting. Aluminum manifolds are well known and are desirable for being lighter than comparable cast iron manifolds. Aluminum manifolds, however, are excellent transmitters of engine noise and are expensive to manufacture.

In more recent prior art, manifolds are typically formed by injection molding of polymer composites in a plurality of separate sections, followed by joining of the sections by welding such as friction welding. See, for example, U.S. Pat. No. 6,679,215, the relevant disclosure of which is herein incorporated by reference. Exemplary polymer composites for use in forming intake manifolds are glass-filled nylon and glass-filled polyphthalamide. Such polymer composite manifolds transmit much less engine noise, are at least as light as aluminum manifolds, and are less expensive to manufacture.

A drawback of polymer composite manifolds manufactured by prior art methods and apparatus is that the wall thickness is limited to about 4 mm, although thicker walls are desirable in some regions of a manifold to reduce transmission of engine vibration and to raise the harmonic frequency of the walls. In modern tuned manifolds, there is typically a septum between two plenums directed to odd and even numbered cylinders, respectively. This septum is typically a flat planar element susceptible to vibration. Attempts to increase the septum thickness above about 4 mm have created increased process cycle times, and have resulted in increased warpage, increased shrinkage, and unacceptable overall dimensional changes in the molded components.

What is needed in the art is means for increasing the effective thickness of a manifold plenum septum without causing unacceptable dimensional changes.

It is a principal object of the present invention to provide an improved manifold having reduced propensity for vibration and noise transmission.

SUMMARY OF THE INVENTION

Briefly described, in a method in accordance with the invention for forming an injection molded manifold, the portion of the mold that forms a septum is modified to produce a substantially thicker septum, preferably about 8.5 mm or greater. In the molding operation, one or more removable slides are inserted through this region of the mold, the slide being about 2.5 mm thick. The septum is cast around the slides which are then withdrawn from the region after the polymer composite is set, resulting in a septum that is preferably about 8.5 mm thick comprising parallel plates each about 3 mm thick and a plurality of open core voids about 2.5 mm high and about 30 mm wide. The improved septum is stiffer than a single 4 mm thick prior art septum and has a higher natural frequency.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
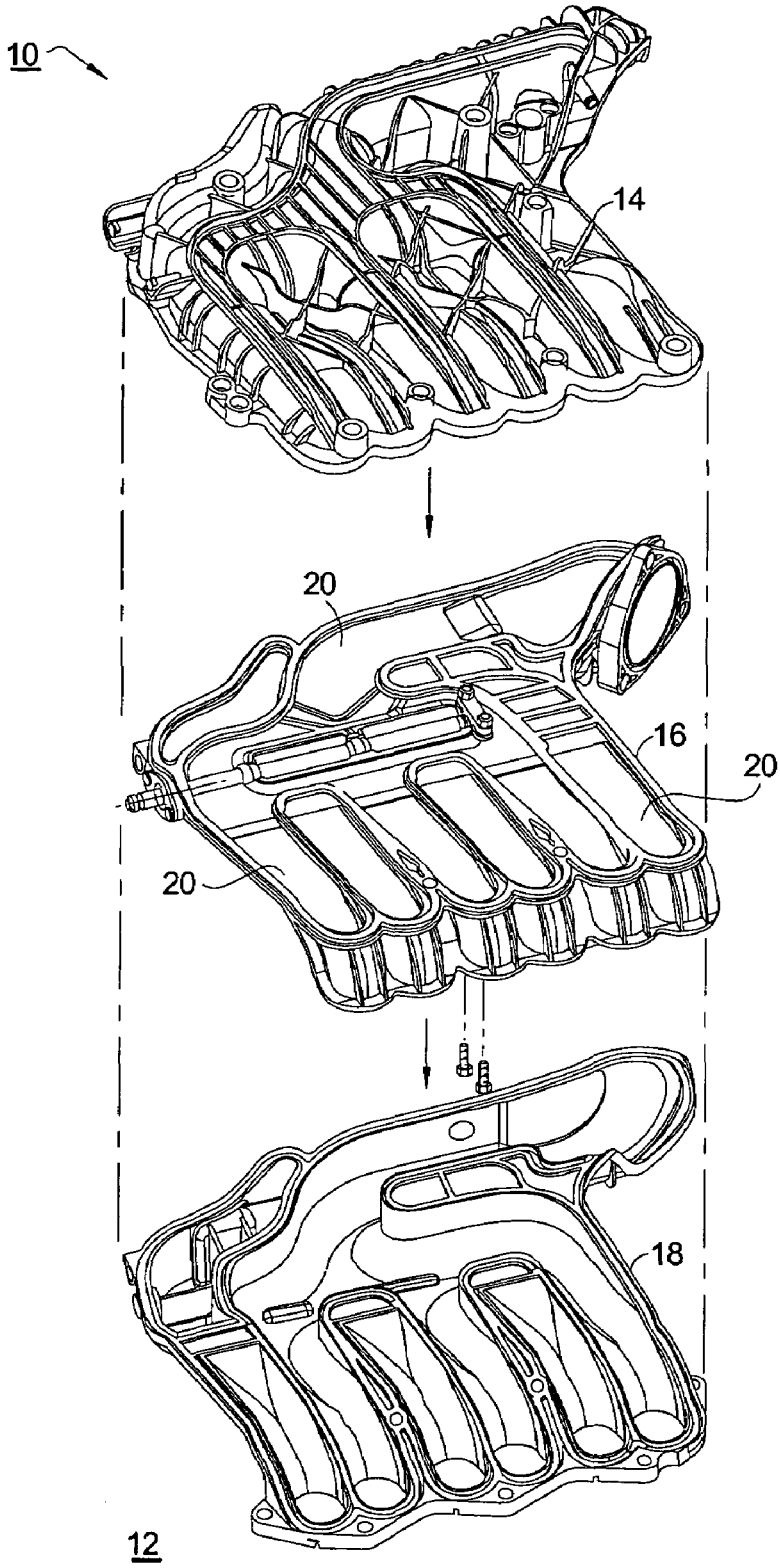
FIG. 1. (PRIOR ART)
FIG. 1 is an exploded isometric view of a prior art three-part injection-molded intake manifold for an in-line six-cylinder engine.

Referring to FIG. 1, a conventional intake manifold 10 for an internal combustion engine 12 is injection molded in three separate shells: upper shell 14, middle shell 16, and lower shell 18. The three shells are assembled together to form manifold 10 as by welding or adhesives. The process of molding and assembling manifold 10 is largely as disclosed in the incorporated U.S. Pat. No. 6,679,215 B2.

The novelty disclosed herein, which is the subject of the present invention, is an improvement in the formation of a septum 20 between upper shell 14 and lower shell 18, which septum may be integral with any of shells 14, 16, 18 or may be formed as an additional element. In a presently preferred embodiment, septum 20 is formed as an integral component of middle shell 16, as shown in FIG. 1.

The shells and septum are typically molded of a heat-resistant fiber-filled polymer composite, such as glass-filled nylon or glass-filled polyphthalamide. In the prior art, the thickness of septum 20 is limited to about 4 mm to avoid excessive shrinkage and distortion of the polymer composite; however, as noted above, a thicker septum is desirable, both for enhanced rigidity and noise suppression.

Figure 2:
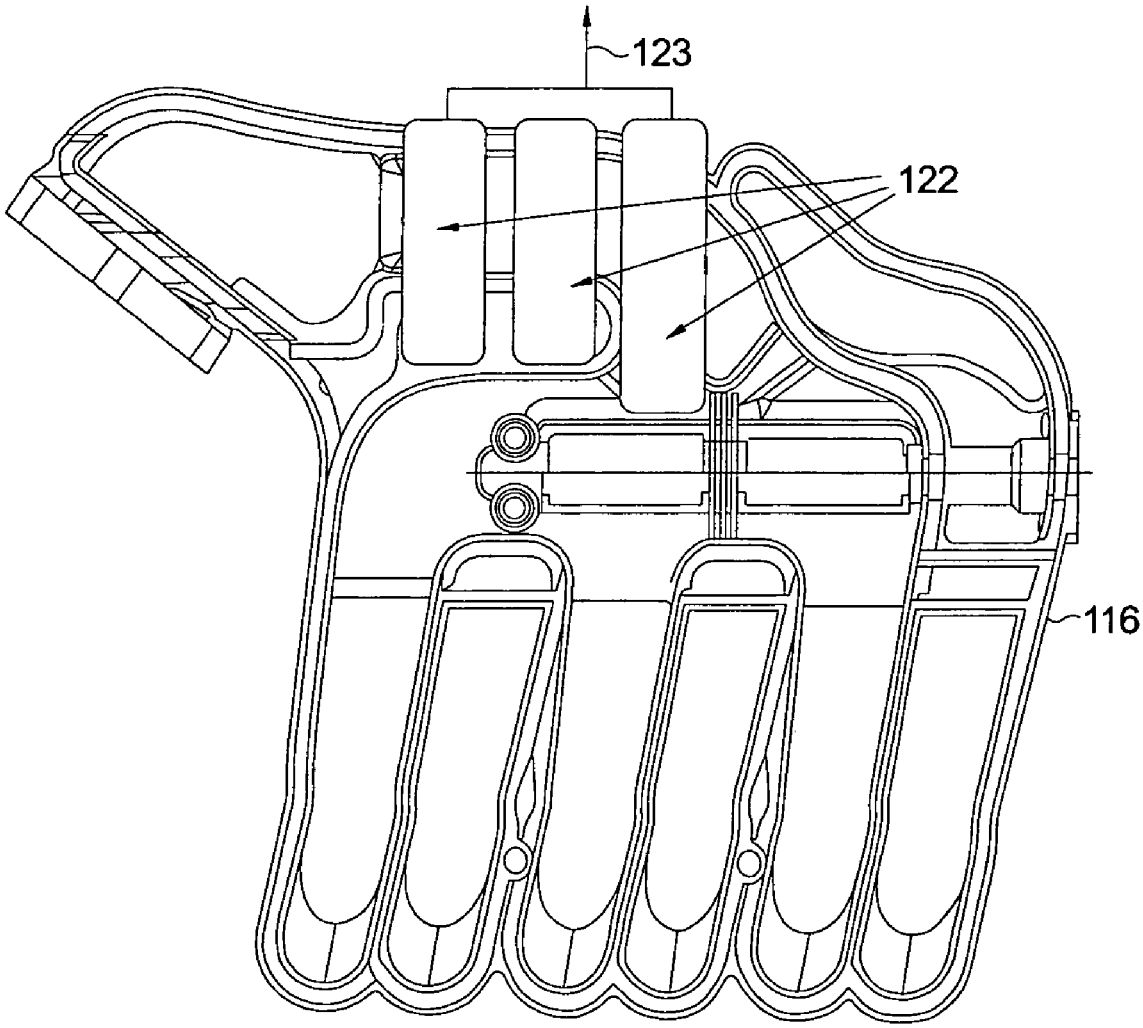
FIG. 2 is a plan view of the underside of the center manifold shell shown in FIG. 1, showing where three slides may be inserted into an improved integral septum (the septum itself is omitted from the drawing, for clarity)
Figure 3:
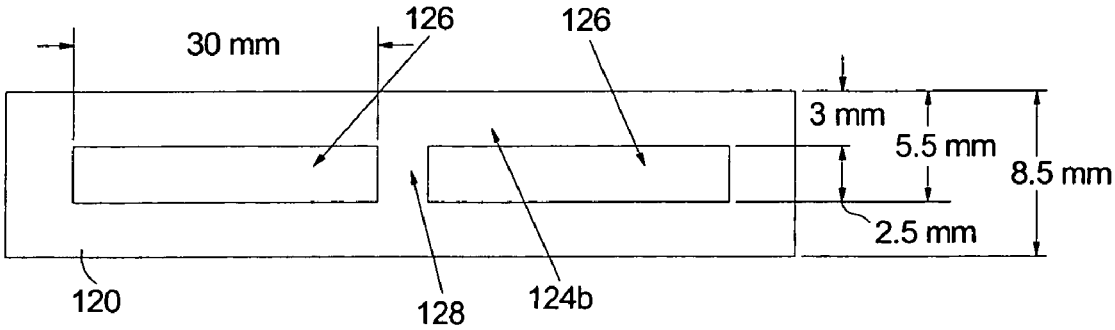
FIG. 3 is a schematic cross-sectional view taken through a portion of an improved cored septum in accordance with the invention, showing the exemplary dimensions of the cored openings, ribs, and plates.

Referring to FIGS. 2 and 3, it has been found that an improved septum 120 can be made significantly thicker than in the prior art if portions of the thicker septum are hollowed out, also known as being "cored" out, in molding. Specifically, one or more lenticular slides 122 are inserted into a mold (not shown) for a thicker septum 120 which preferably is a component of an improved middle shell 116. Three such slides 122 are shown in FIG. 2 When the mold is filled with liquid polymer composite, the slides 122 displace composite in designated regions of the mold. After the composite material is set, the slides are withdrawn 123 from the molded septum 120, resulting in a region of the septum having a structure comprising parallel plates 124*a*,124*b* separated by lenticular voids 126 (see FIG. 6). Plates 124*a*, 124*b* are spaced apart in a first direction and are connected by ribs 128 separating voids 126 and spaced apart in a second direction. In a presently preferred embodiment, as shown in FIG. 3, plates 124*a*, 124*b* are each about 3 mm thick, and voids 126 are about 2.5 mm high and about 30 mm wide. Greater thicknesses of plates and voids are possible within the scope of the invention. The result is an I-beam type structure having an overall thickness of about 8.5 mm, which is relatively light, strong, rigid, and less prone to transmission of noise than the prior art solid septum 20.

Figure 6:
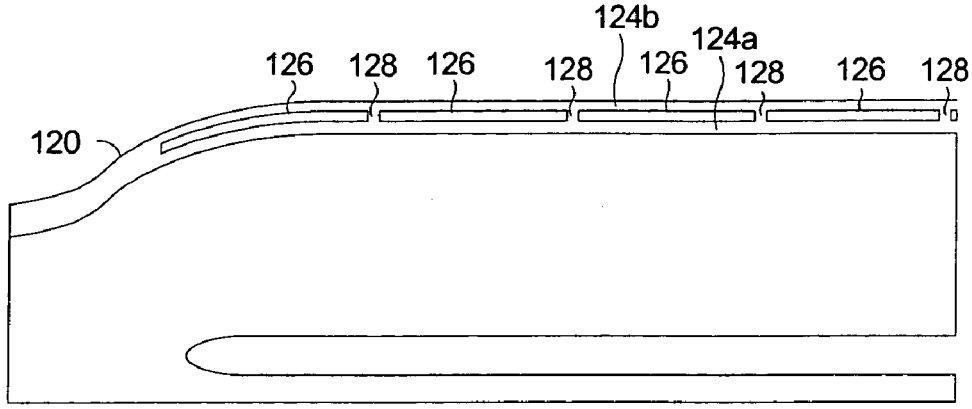
FIG. 6 is an isometric view from below of a portion of the septum shown in FIG. 4 showing cored openings and ribs in the septum.
Figure 5:
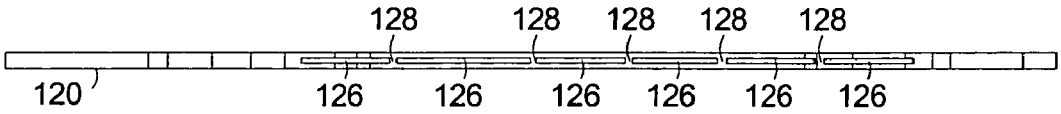
FIG. 5 is an elevational view of the septum shown in FIG. 4.
Figure 4:
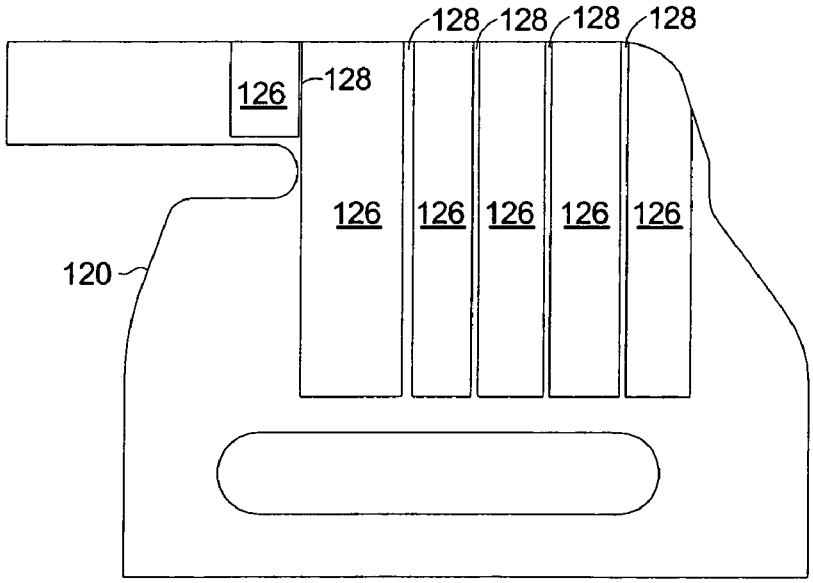
FIG. 4 is a cross-sectional view of a cored manifold septum formed by coring with six different slides.

Referring to FIGS. 4 through 6, a currently preferred septum 120 for an intake manifold for the six-cylinder engine 12 shown in FIG. 1 is formed with six lenticular voids 126 extending varying distances into the septum. It is important that the voids open on the outside of the manifold, where the slides have been withdrawn, and not extend into the gas or fuel flow paths within the manifold. The voids should remain open in use to avoid captive air spaces which can subject the manifold to unwanted mechanical stresses during thermal changes.

Ribs 128 are shown exemplarily as being formed substantially orthogonal to plates 124*a*, 124*b*; however, it will be recognized that the ribs may be formed at non-normal angles (not shown) to the plates, like trusses, if so desired by appropriate modification of the cross-sectional shape of slides 122.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A manifold for an internal combustion engine including a region formed of first and second plates spaced apart in a first direction and connected at intervals by a plurality of ribs spaced apart in a second direction to define a plurality of voids between said plates and said ribs in said region of said manifold wherein said region is included in a septum for separating flow paths within said manifold.

2. A manifold in accordance with claim 1 wherein said manifold is an air intake manifold.

3. A manifold in accordance with claim 1 wherein said manifold is formed by injection molding.

4. A manifold in accordance with claim 1 wherein said manifold is formed of a polymer composite material.

5. A manifold in accordance with claim 4 wherein said polymer composite material is selected from the group consisting of glass-filled nylon and glass-filled polyphthalamide.

6. A manifold in accordance with claim 1 wherein said ribs are formed orthogonal to said plates.

7. In a manifold for an internal combustion engine said manifold including a region formed of first and second spaced apart plates and connected at intervals by a plurality of spaced apart ribs to define a plurality of voids between said plates and said ribs in a region of said manifold, a method for forming said manifold comprising the steps of:

a) providing at least one slide for insertion into a manifold mold prior to entry of molten material for forming said region of said manifold;

b) injecting said molten material into said mold around said slide;

c) causing said material to become rigid; and d) withdrawing said slide from said rigid material to form at least one of said plurality of voids in said manifold region.

* * * * *